US005833083A

United States Patent [19]

Miller

[11] Patent Number: 5,833,083

[45] Date of Patent: Nov. 10, 1998

[54] DRYING RACK

[76] Inventor: Dirk Miller, 3358 175th St., Wever, Iowa 52658

[21] Appl. No.: 751,994

[22] Filed: Nov. 15, 1996

[51] Int. Cl.[6] ..... A47F 5/00

[52] U.S. Cl. ..... 211/134; 211/150; 211/175

[58] Field of Search ..... 211/150, 186, 211/188, 134, 175, 180, 181, 194, 135, 153, 172; 108/53.5, 53.1, 53.3, 91, 93, 94, 97, 101, 157; 34/192, 237, 238; 312/297; 297/440.11

[56] References Cited

U.S. PATENT DOCUMENTS

| | | | |
|---|---|---|---|
| 156,059 | 10/1874 | Jordan | 211/181.1 X |
| 291,030 | 1/1884 | Clapper | 211/134 X |
| 442,148 | 12/1890 | Singley | 211/134 X |
| 584,811 | 6/1897 | Caldwell | 211/134 |
| 725,851 | 4/1903 | Kopp | 211/134 |
| 1,104,970 | 7/1914 | Dean | 211/181.1 X |
| 1,350,367 | 8/1920 | Giddings . | |
| 1,640,083 | 8/1927 | Ladd | 211/186 |
| 2,521,100 | 9/1950 | Sublette . | |
| 2,562,497 | 7/1951 | Klein | 211/181.1 X |
| 2,885,090 | 5/1959 | Foreman et al. | 211/175 |
| 3,003,248 | 10/1961 | Wittie | 34/95 |
| 3,390,784 | 7/1968 | Fuchs | 211/150 |
| 3,403,789 | 10/1968 | Morte et al. | 211/150 |
| 3,421,458 | 1/1969 | Salkoff et al. | 108/134 |
| 3,596,770 | 8/1971 | Heinrich | 211/150 |
| 3,675,338 | 7/1972 | Maki . | |
| 3,814,030 | 6/1974 | Morgan, III | 297/452.64 X |
| 4,828,123 | 5/1989 | Basone . | |
| 5,244,104 | 9/1993 | Green et al. | 211/150 |
| 5,393,126 | 2/1995 | Boulva | 297/440.11 X |
| 5,505,318 | 4/1996 | Goff | 211/90 |
| 5,520,118 | 5/1996 | McCarthy | 108/42 |

*Primary Examiner*—Milton Nelson, Jr.
*Attorney, Agent, or Firm*—Zarley McKee Thomte Voorhees & Sease

[57] ABSTRACT

A drying rack is provided with a plurality of self-supporting shelves. The shelves telescope with respect to one another to provide easy loading and unloading of objects, such as clothing garments, to be dried upon the shelves. Each shelf comprises a frame member over which a jacket is slidably fit. The jacket is constructed of a mesh fabric to allow air circulation therethrough. The jacket can be easily removed from the frame member for cleaning, if necessary.

15 Claims, 3 Drawing Sheets

DRYING RACK

BACKGROUND OF THE INVENTION

Racks of various configurations are well known for drying miscellaneous objects, such as clothes. One form of rack includes a plurality of rods or bars over which clothing is hung for drying. Such hanging racks are undesirable for certain garments, such as sweaters, which may stretch when hung. Another form of rack includes one or more shelves upon which the clothing or object is placed for drying. The dye from some garments may bleed onto the rack shelf, where the dye may then be undesirably transferred to the next wet garment placed upon the shelf. Also, in such multiple shelf prior art racks, the shelves typically must be loaded from bottom to top, and unloaded from top to bottom. Thus, no selection in the order of loading or unloading is available, which decreases efficiencies for clothes requiring different drying times.

Accordingly, a primary objective of the present invention is the provision of an improved drying rack for objects, such as clothing.

Another objective of the present invention is the provision of a drying rack having shelves with removable jackets.

A further objective of the present invention is the provision of an improved drying rack having telescoping shelves for easy loading of objects to be dried.

Still a further objective of the present invention is the provision of an improved drying rack having shelves which are pivotal between raised and lowered positions.

Another objective of the present invention is the provision of a drying rack having an air-permeable shelf to facilitate drying.

Still a further objective of the present invention is the provision of a clothes drying rack having a shelf including a slip-on jacket which is removable for cleaning.

Another objective of the present invention is the provision of an improved method of drying objects, such as clothing, on a rack.

A further objective is the provision of a drying rack having multiple shelves, each of which can be loaded and unloaded independently of the other shelves.

These and other objectives will become apparent from the following description of the invention.

SUMMARY OF THE INVENTION

The drying rack of the present invention includes a plurality of self-supporting frame members extending substantially horizontally, one above the other. The frame members include a pair of support arms and a U-shaped conduit or tube having opposite sides adapted to be slidably received on the support arms such that the shelf telescopes, or is extensible. A mesh jacket slidably fits over the U-shaped conduit and defines a shelf upon which an object is set for drying. The mesh material allows complete air circulation around the object, to facilitate drying. If the jacket becomes soiled or stained, such as with bleeding dye from a clothes garment, the jacket can be quickly and easily removed from the conduit for cleaning.

In one embodiment the support arms are fixed to upright posts or a wall. In an alternative embodiment, the support arms are pivotally connected to the posts or wall, such that the shelves are pivotally movable between a raised storage position and a lowered use position.

In the method of the present invention, a shelf is extended outwardly for easy loading of an object to be dried. The object, such as an article of clothing, is placed upon the mesh jacket and the shelf can then be retracted so that additional shelves can be loaded. After the object is dried, the jacket can be removed from the frame member for cleaning, if necessary, so as to prevent damage to the next object to be dried on the shelf.

DESCRIPTION OF THE PREFERRED EMBODIMENT

Figure 1:
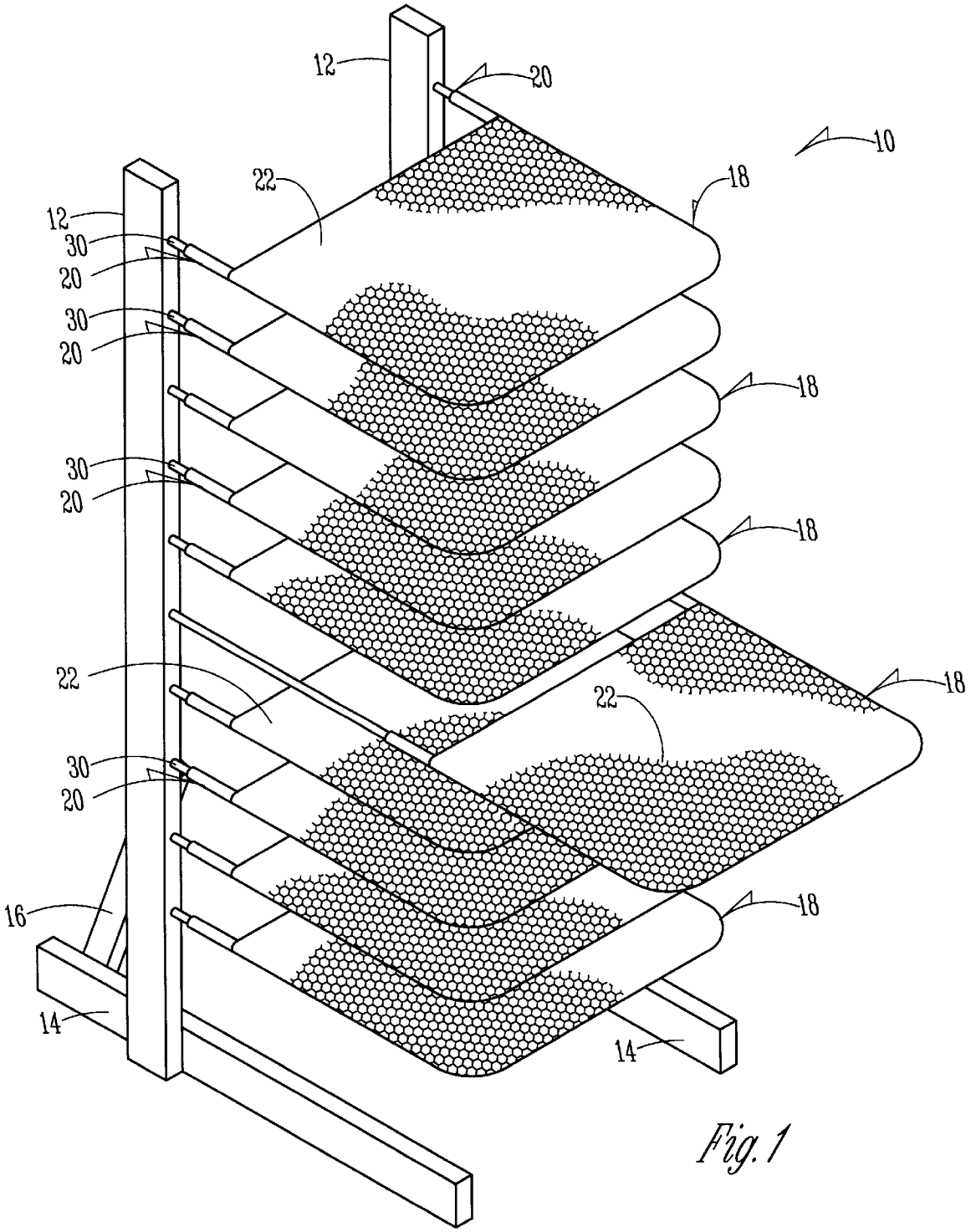
FIG. 1 is a perspective view of the drying rack of the present invention, with one shelf extended to illustrate a loading position of the shelf.
Figure 2:
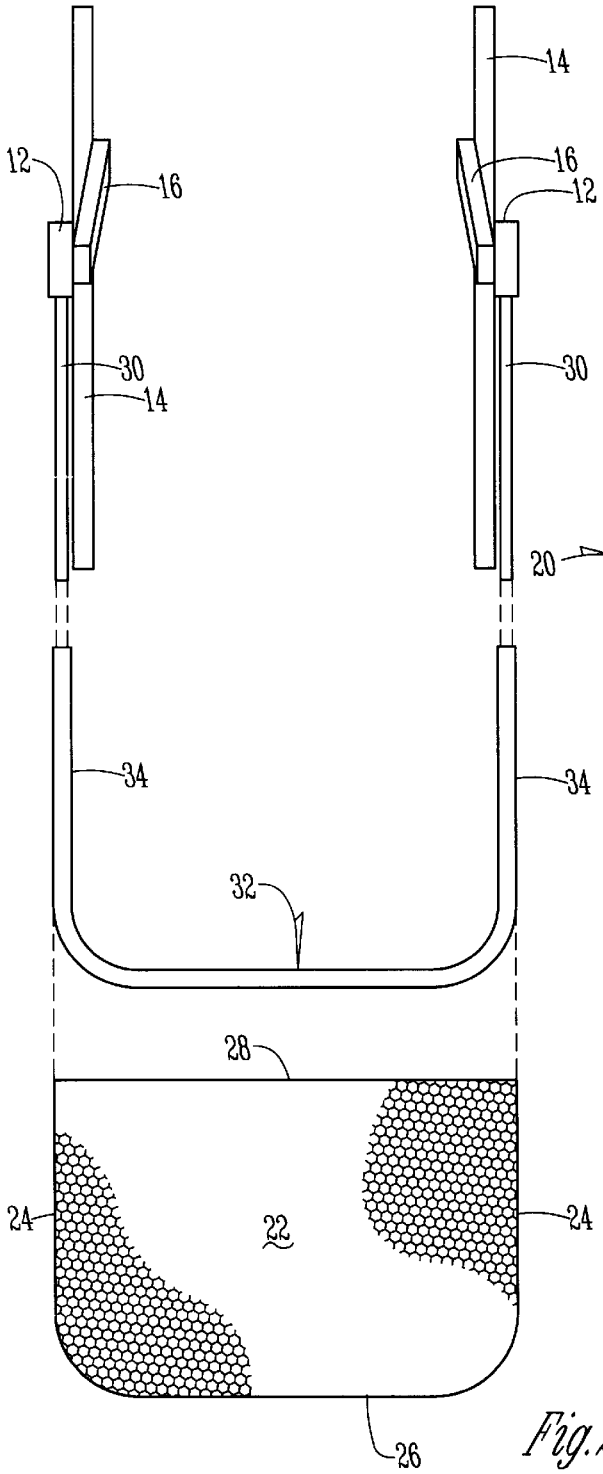
FIG. 2 is an exploded top view of a shelf of the drying rack.

The drying rack of the present invention is generally designated by the reference numeral 10 in the drawings. The rack includes a pair of upright posts 12 securely mounted to legs 14, with braces 16 providing structural support to the posts 12.

Figure 4:
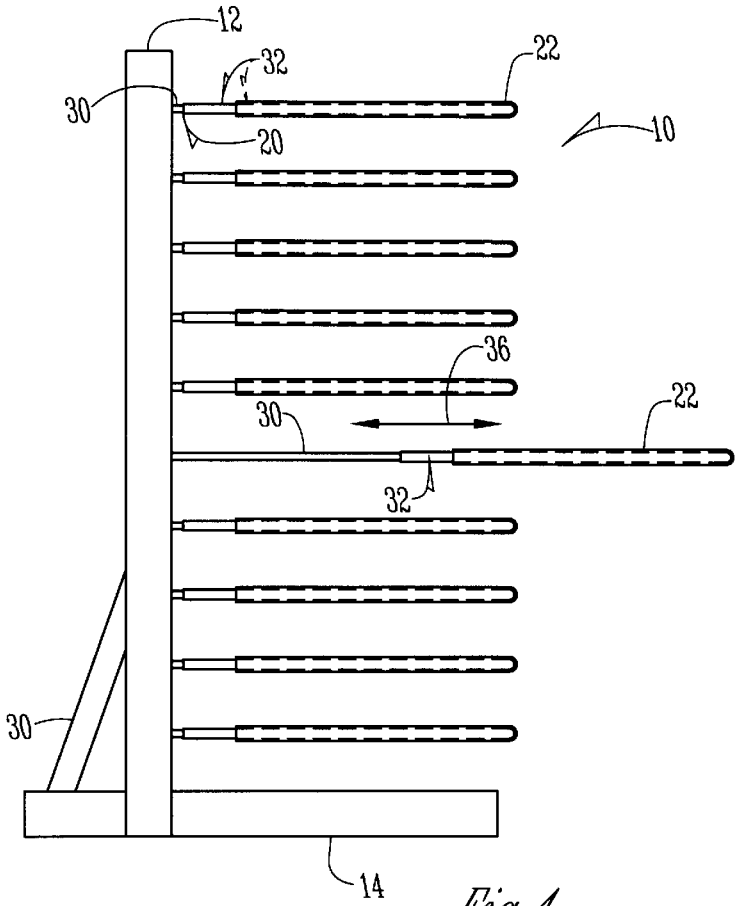
FIG. 4 is a side elevation view of the drying rack of FIG. 1.

The rack also includes a plurality of horizontally disposed shelves 18 generally positioned one above another, as seen in FIGS. 1 and 4. Each shelf 18 includes a frame member 20 and a removable jacket or slip cover 22 slidably fit over the frame member 20. The jacket 22 is preferably made from a mesh fabric so as to be air permeable, such that air can circulate through the jacket 22, thereby facilitating drying of an object placed upon the jacket 22. For example, the jacket 22 can be constructed of a nylon mesh material or fabric.

The jacket 22 includes opposite sides 24, a forward end 26, and a rearward end 28. The jacket is closed on the opposite sides 24 and the forward end 26, and open on the rearward end 28, so as to define a pocket therein for receiving the frame member 20.

Figure 3:
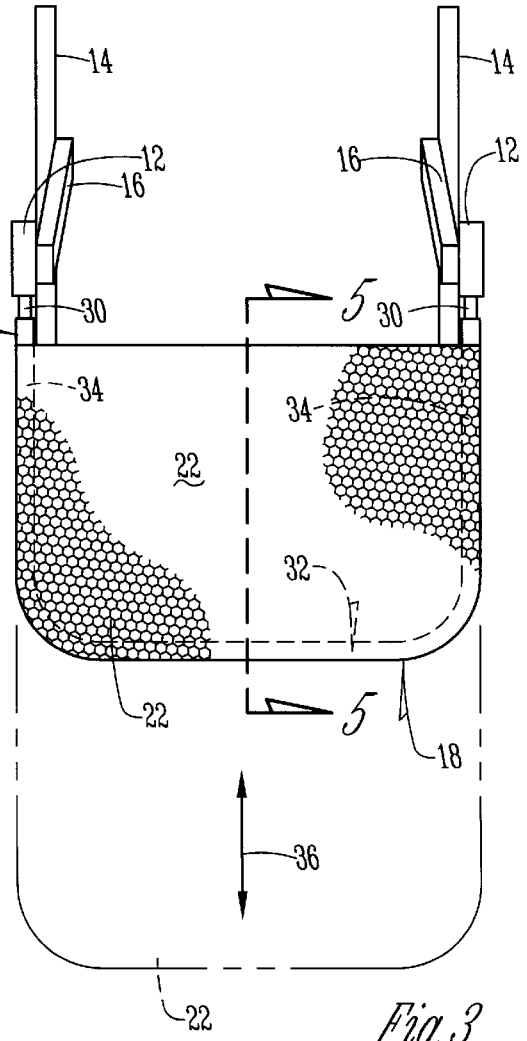
FIG. 3 is an assembled top view of a shelf of the drying rack of the present invention.

Preferably, the shelves 18 are telescoping to permit easy loading and unloading. More particularly, each frame member 20 includes a pair of support arms 30 extending horizontally outwardly from the respective posts 12. A U-shaped conduit or tube 32 has opposite sides 34 adapted to be slidably fit upon the respective support arms 30 such that the conduit can be telescoped outwardly and inwardly, as indicated by the arrows 36 in FIGS. 3 and 4. The conduit 32 fits within the pocket of the jacket 22.

Figure 6:
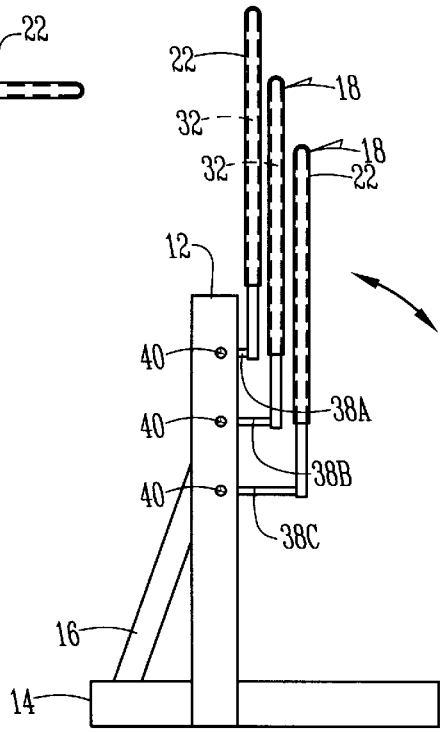
FIG. 6 is a side elevation view of an alternative embodiment wherein the shelves are pivotally mounted for movement between raised and lowered positions.
Figure 5:
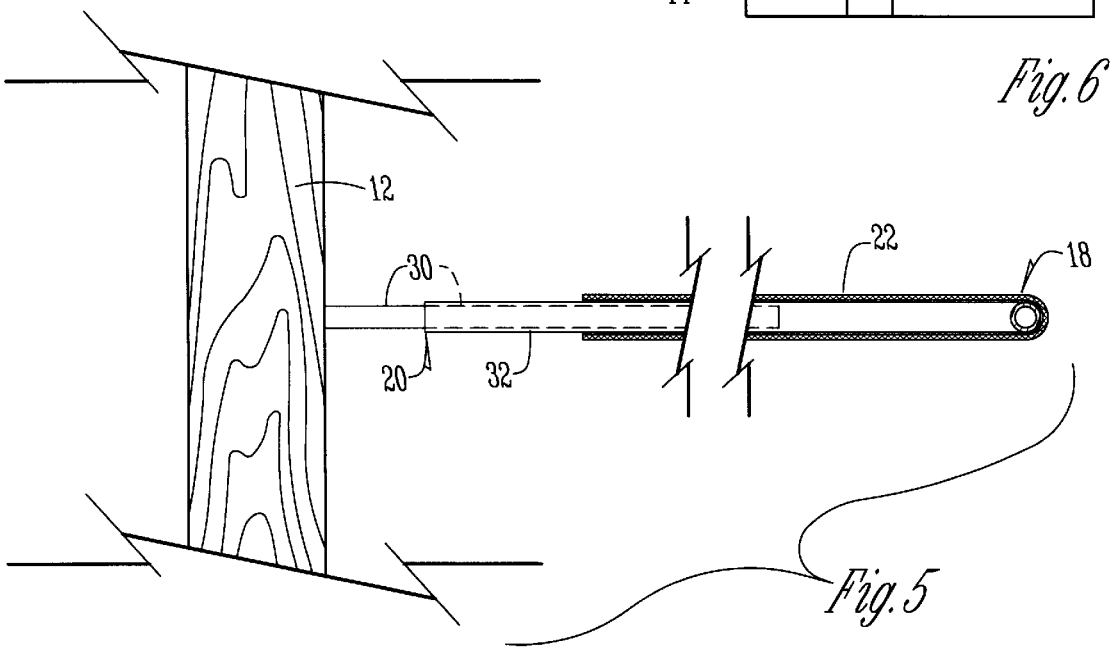
FIG. 5 is a sectional view taken along lines 5—5 of FIG. 3.

FIG. 6 shows an alternative embodiment of the drying rack wherein similar reference numerals are used to designate similar structure as for the rack shown in FIGS. 1–5. In the alternative embodiment, the support arms 30 are mounted upon brackets 38A, 38B, and 38C, respectively. The brackets 38A, 38B and 38C are mounted to the upright posts 12 such that the shelves 18 are pivotable about a hinge pin 40. Thus, the shelves 18 are pivotally movable between a raised storage position, as shown in FIG. 6, and a lowered use position, similar to FIG. 4. It is noted that each mounting bracket 38A, 38B, and 38C is successively longer than the adjacent bracket, from top to bottom, such that the shelf can be moved to the raised position without interference.

The method of using the drying rack of the present invention includes the first step of extending a shelf outwardly for easy loading of an object, such as a shirt or sweater, to be dried. Such telescoping of the shelf is quickly and easily accomplished simply by pulling the U-shaped conduit 32 outwardly along the support arms 30. After the object is loaded onto the mesh jacket 22, the shelf can be quickly and easily retracted by sliding the conduit 32 rearwardly upon the support arms 30. The spacing between the shelves 18 allows air to circulate around the shelves. Also, the mesh construction of the jacket 22 allows air to circulate through the jacket to facilitate drying of an object placed upon the jacket 22. Additional shelves can be loaded in a similar manner. When drying is complete, the shelf can again be extended outwardly for easy unloading of the object. In the case of clothing, if dye has bled onto the jacket 22, or the jacket has otherwise become soiled or stained, the jacket can be quickly and easily removed from the conduit 32 for washing. Thus, a clean jacket 22 is provided for all objects to be dried upon the shelf. Also, since the shelves can be extended and retracted independently of one another, the shelves can be loaded and unloaded in any order. Thus, objects requiring different drying times can be placed on different shelves without loss of use of other shelves. This independent operation of the shelves maximizes drying efficiencies of the rack.

Whereas the invention has been shown and described in connection with the preferred embodiments thereof, it will be understood that many modifications, substitutions, and additions may be made which are within the intended broad scope of the following claims. For example, the upright posts 12 may take other forms, and the support arms 30 may be directly connected to a wall, without departing from the scope of the present invention. From the foregoing, it can be seen that the present invention accomplishes at least all of the stated objectives.

What is claimed is:

1. A clothes drying rack comprising: a plurality of frame members extending substantially horizontally, one above another;

a removable flexible jacket adapted to matingly receive and fit around each frame member to provide a shelf upon which an article of clothing to be dried can be set;

a pair of support arms attached to each frame member, and a U-shaped conduit having opposite sides adapted to be slidably received on the support arms such that the shelf is extensible.

2. The clothes drying rack of claim 1 wherein the jacket is constructed of a fabric material.

3. The clothes drying rack of claim 1 wherein the jacket is a mesh material.

4. The clothes drying rack of claim 1 wherein the frame members telescope between extended and retracted positions.

5. The drying rack of claim 1 wherein the jacket is a netting to permit air to pass therethrough.

6. The drying rack of claim 1 wherein the frame members are pivotally mounted to a support for pivotal movement between raised and lowered positions.

7. The drying rack of claim 1 wherein the frame member includes telescoping members such that the shelf is extendible and retractable.

8. A clothes drying rack comprising:

a plurality of frame members extending substantially horizontally, one above another;

a removable flexible jacket adapted to matingly receive and fit around each frame member to provide a shelf upon which an article of clothing to be dried can be set;

the frame members being pivotally mounted to a support for pivotal movement between an upright storage position and a horizontal use position.

9. A drying rack of claim 8 wherein the jacket is a mesh material.

10. The drying rack of claim 8 wherein the frame member includes a pair of support arms and a pair of tubular members slidably mounted on the support arms.

11. The drying rack of claim 8 wherein the frame member includes a pair of horizontally disposed support arms and a U-shaped conduit having opposite sides slidably mounted on the support arms.

12. The clothes drying rack of claim 8 wherein the jacket is constructed of a fabric material.

13. The drying rack of claim 8 wherein the frame members include telescoping members such that the shelf is extendible and retractable.

14. A method of drying objects on a rack having pairs of telescoping arms the method comprising: slipping a removable flexible jacket over each pair of arms so as to form a shelf between each pair of arms; extending one shelf outwardly relative to an adjacent upper shelf; placing an object to be dried on the extended shelf; circulating air over the object and through the jacket to facilitate drying; removing the object from the shelf; and removing the jacket for cleaning.

15. The method of claim 14 wherein the shelf is retracted after the object is placed thereon.

* * * * *